US009735487B2

(12) United States Patent
Fan et al.

(10) Patent No.: US 9,735,487 B2
(45) Date of Patent: Aug. 15, 2017

(54) ELECTRICAL CARD CONNECTOR WITH CONTACT MODULE

(71) Applicant: FOXCONN INTERCONNECT TECHNOLOGY LIMITED, Grand Cayman (KY)

(72) Inventors: Ding-Bing Fan, Kunshan (CN); Ce Jiang, Kunshan (CN); Ji-Chao Wang, Kunshan (CN); Guo-Hua Zhang, Kunshan (CN); Qi-Sheng Zheng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 238 days.

(21) Appl. No.: 14/604,642

(22) Filed: Jan. 23, 2015

(65) Prior Publication Data

US 2015/0207252 A1 Jul. 23, 2015

(30) Foreign Application Priority Data

Jan. 23, 2014 (CN) ..... 2014 2 0041252 U

(51) Int. Cl.

| | |
|---|---|
| ***H01R 24/00*** | (2011.01) |
| ***H01R 13/10*** | (2006.01) |
| ***H01R 33/00*** | (2006.01) |
| ***H01R 12/72*** | (2011.01) |
| ***H01R 13/15*** | (2006.01) |

(Continued)

(52) U.S. Cl.

CPC ..... *H01R 12/721* (2013.01); *H01R 12/737* (2013.01); *H01R 13/15* (2013.01); *H01R 13/2442* (2013.01)

(58) Field of Classification Search

CPC .... H01R 13/15; H01R 12/721; H01R 12/737; H01R 13/2442

USPC ..... 439/630, 634, 862

See application file for complete search history.

(56) References Cited

U.S. PATENT DOCUMENTS 4,083,617 A * 4/1978 Wyatt ..... H01R 13/28 439/295

6,354,891 B1 * 3/2002 Schnell ..... H01R 13/2442 439/630

(Continued)

FOREIGN PATENT DOCUMENTS

TW M397629 2/2011

*Primary Examiner* — Felix O Figueroa

(74) *Attorney, Agent, or Firm* — Wei Te Chung; Ming Chieh Chang

(57) ABSTRACT

A card connector includes an insulative housing, a plurality of contacts received in the insulative housing and a metallic cover covering the insulative housing. The contact includes a retaining portion, an extending portion horizontally and forwardly extending from the retaining portion, a connecting portion downwardly and forwardly aslant extending from the extending portion, a floating portion downwardly from the connecting portion and a contacting portion further downwardly extending from the floating portion. There are two bending points on linking portions of the connecting portion connecting with the floating portion and the extending portion, respectively. By such arrangement, when the electrical card is inserted, the contact can rotate about the two bending points in turn, that can improve an elasticity of the contact.

19 Claims, 6 Drawing Sheets

(51) Int. Cl.
*H01R 13/24* (2006.01)
*H01R 12/73* (2011.01)

(56) References Cited

U.S. PATENT DOCUMENTS 6,623,316 B1 * 9/2003 Wu ..... H01R 12/714
439/188
7,153,152 B1 * 12/2006 Eby ..... H01R 13/15
439/295
8,974,246 B2 * 3/2015 Son ..... H01R 13/2428
439/500

* cited by examiner

ELECTRICAL CARD CONNECTOR WITH CONTACT MODULE

BACKGROUND OF THE INVENTION

1. Field of the Invention

The present invention relates to an electrical card connector, and more particularly to an electrical card connector with contact module. This application relates to the copending application Ser. No. 14/604,640.

2. Description of Prior Arts

TaiWan Patent No. M397629, published on Feb. 1, 2011 discloses an electrical card connector. The electrical card connector includes an insulative housing, a plurality of contacts received in the insulative housing, and a shell covering the insulative housing. Each of the contact includes a fixing portion, a connecting portion extending from the fixing portion forwardly, and an engaging portion extending from the connecting portion forwardly. When an electrical card is inserted into the electrical card connector, the electrical card pushes the engaging portion and the engaging portion drives the connecting portion rotary around a connecting point between the fixing portion and the connecting portion. Under a long-term use, the contact may occur a permanent deformation in the connecting point, and the electrical card connector will be in a bad usage effect.

An electrical card connector having a plurality of contacts in a stable state is desired.

SUMMARY OF THE INVENTION

An electrical card connector comprises an insulative housing, an contact module fixed in the insulative housing, and a shell covering the insulative housing. The contact module has an insulative block and a plurality of conductive contacts. Each of the conductive contacts comprises a fixing portion extending along a horizontal direction and received in the insulative block, an extending portion extending from the fixing portion forwardly, a floating portion extending from the extending portion downwardly, and an engaging portion bending from the floating portion downwardly. The conductive contact defines a bending point between the floating portion and the extending portion. The insulative block comprises a plurality of tubers protruding from a front face forwardly, and located behind the floating portion and under the extending portion. When the engaging portion is pushed backwardly, the floating portion deflects around the bending point and relies on the tuber.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
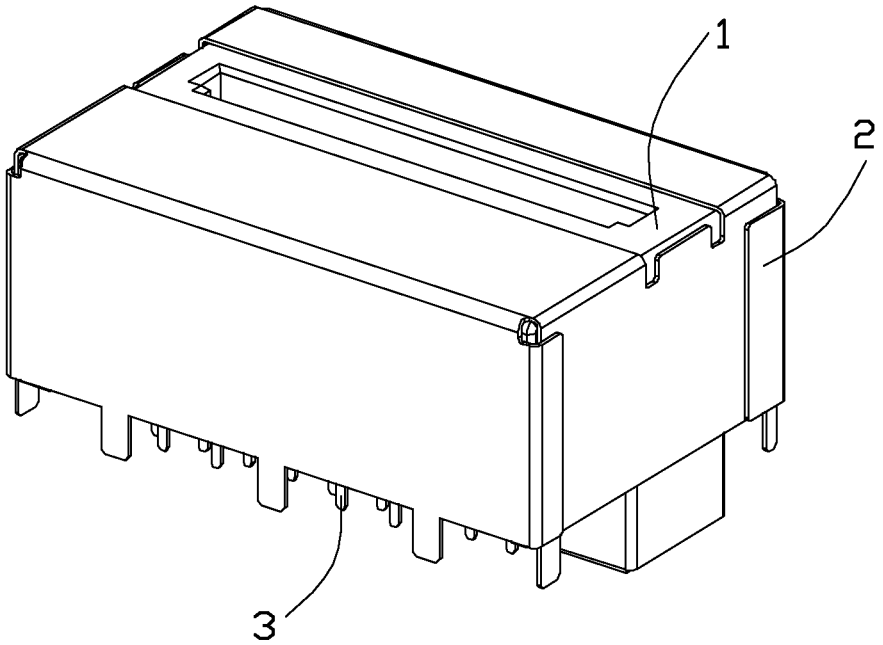
FIG. 1 is a perspective view of an electrical card connector in accordance with the present invention.

Reference will now be made to the drawing figures to describe the present invention in detail.

Figure 2:
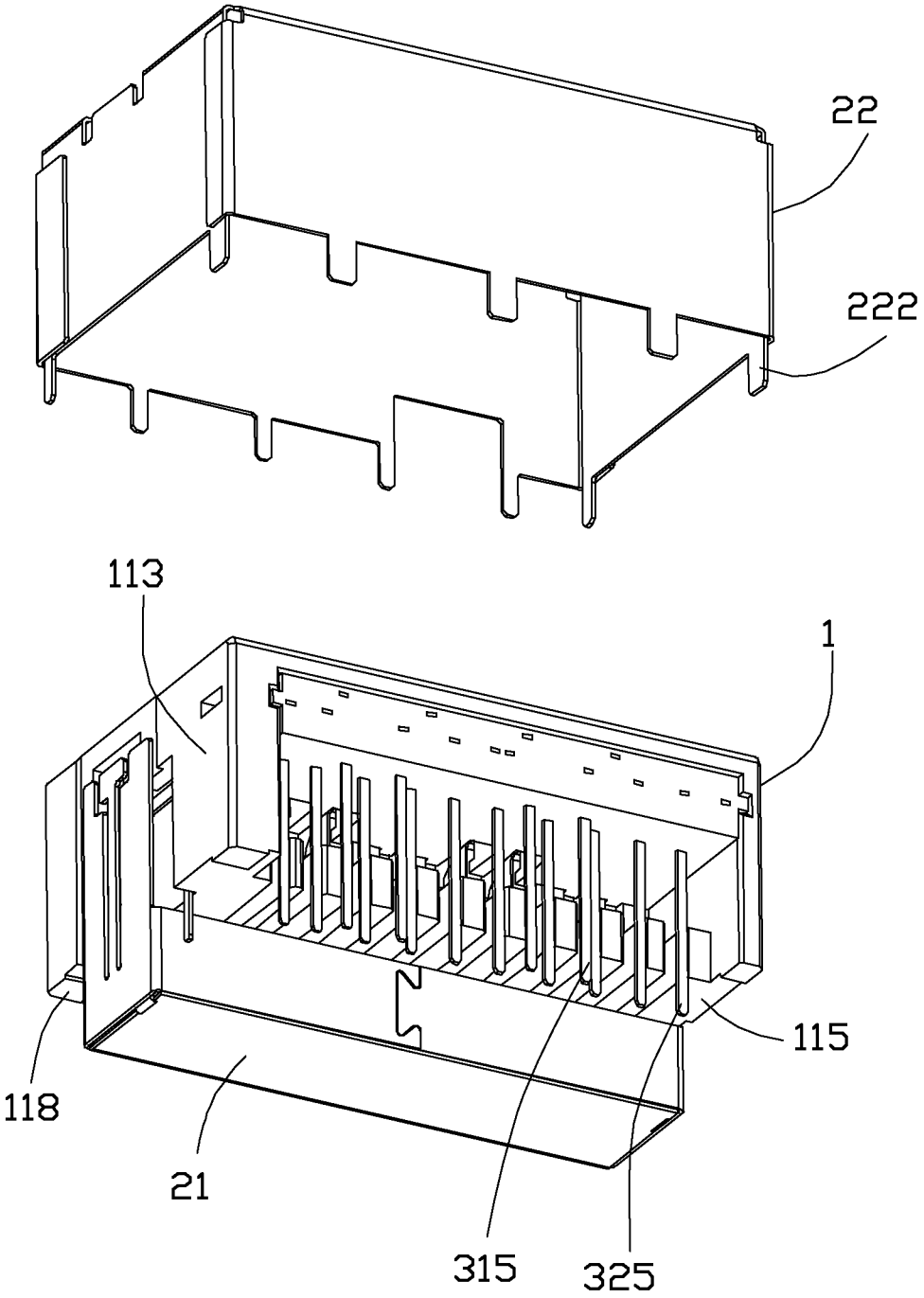
FIG. 2 is an exploded view of the electrical connector as shown in FIG. 1.
Figure 3:
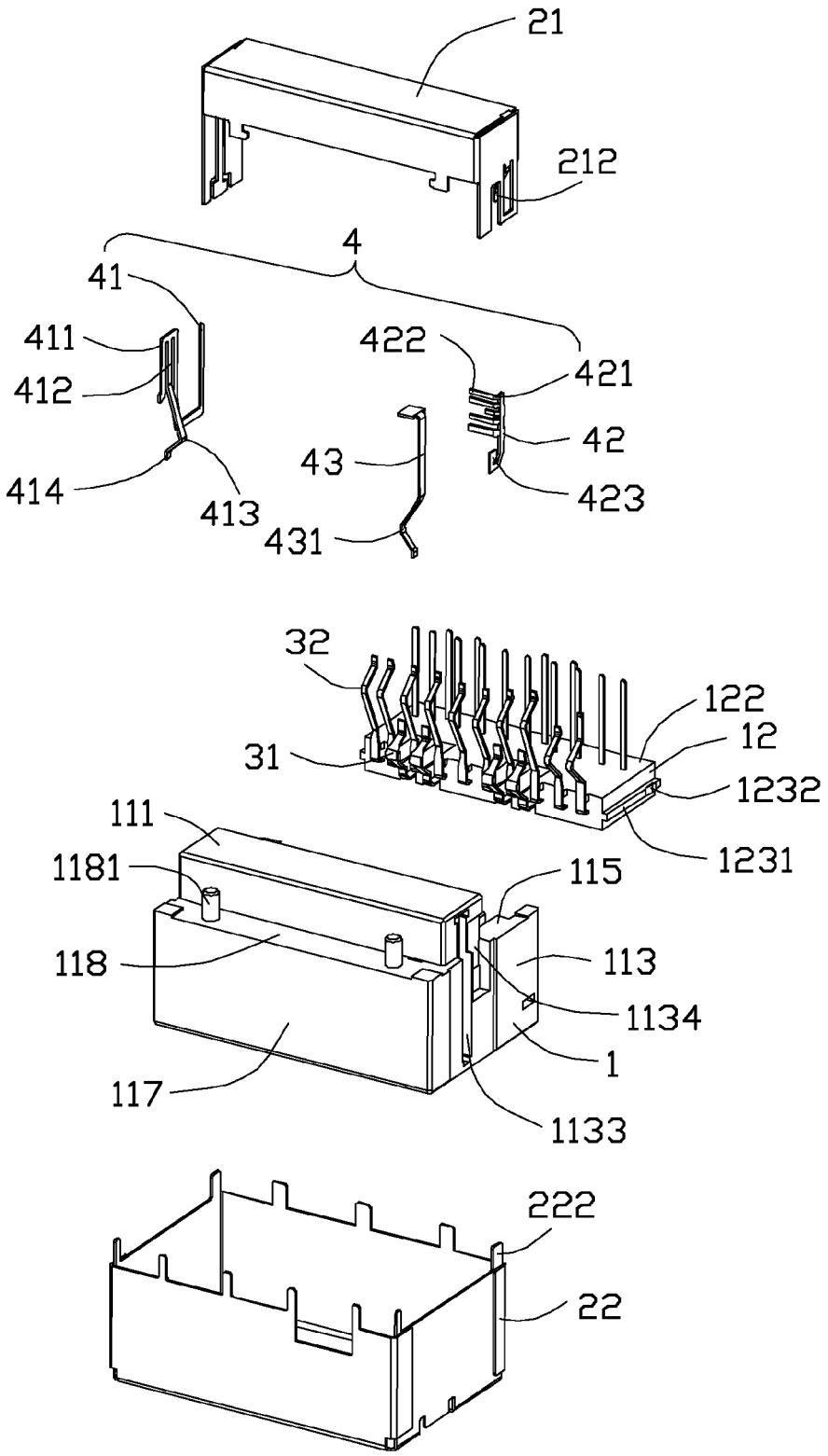
FIG. 3 is a further exploded view of the electrical connector as shown in FIG. 2.

FIGS. 1-3 show an electrical card connector including an insulative housing 1, a contact module 3 received in the insulative housing 1, a plurality of additional contacts 4, and a shell 2 covering the insulative housing 1.

FIGS. 2-5 show the insulative housing 1 including a bottom wall 111, a top wall 112, two side walls 113 connecting the bottom wall 111 and the top wall 112, a rear wall 114, a front wall 117, and a connecting wall 116. The connecting wall 116 is defined between the front wall 117 and the rear wall 114. The connecting wall 116 connects the top wall 112 with the bottom wall 111. The insulative housing 1 includes a receiving space or slot 1120 used for receiving an electrical card (not shown). The receiving space 1120 is formed by the front wall 117, the bottom wall 111, two side walls 113 and the connecting wall 116. The receiving space 1120 extends through the top wall 112, and an opening 1121 is formed in the top wall 112. The electrical card is inserted into the receiving space 1120 through the opening 1121. The insulative housing 1 includes a front mounting wall 118 and a rear mounting wall 115, and a mounting space 1141 recessed from the rear wall 114 forwardly. The connecting wall 116 includes a plurality of contact receiving slots 1161 connecting with the receiving space 1120. The rear mounting wall 115 includes a plurality of contact fixing slots 1151 aligned to the contact receiving slots 1161, respectively. The insulative housing 1 includes two grooves 1131 each defined on inside of the two side walls 113 and a fixing slot 1132 behind the groove 1131.

Figure 4:
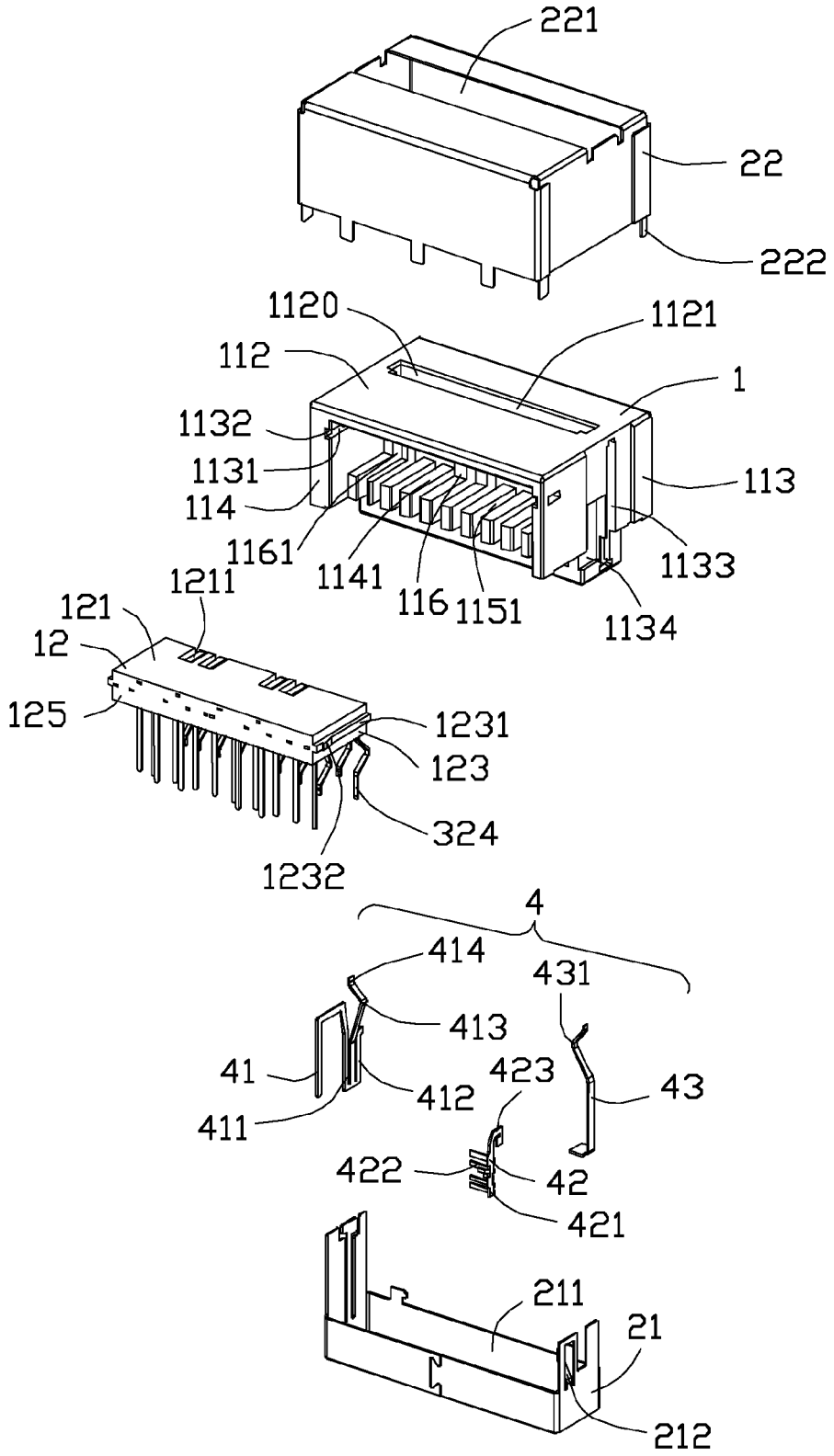
FIG. 4 is another exploded view of the electrical connector as shown in FIG. 3.
Figure 5:
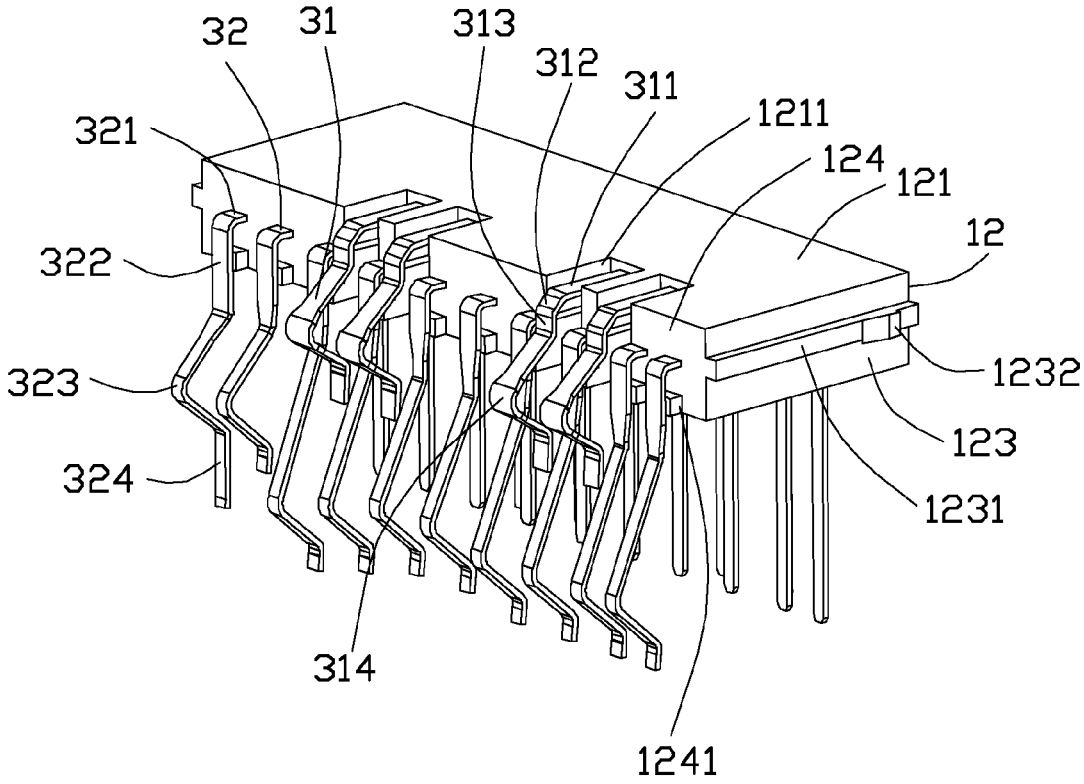
FIG. 5 is a perspective view of a contact module of the electrical card connector as shown in FIG. 4.

FIGS. 4-5 show the contact module 3 mounted into the mounting space 1141 of the insulative housing 1 from a back-to-front direction. The contact module 3 includes an insulative block 12 and a plurality of contacts fixed to the insulative block 12. The insulative block 12 includes a top face 121, a bottom face 122, two side faces 123 connecting the top face 121 with the bottom face 122, a front face 124 and a rear face 125. The insulative block 12 includes a plurality of cutouts 1211 recessed from the front face 124 backwardly and extending through the top face 121 and the bottom face 122. The insulative block 12 includes a plurality of ribs 1231 protruding from each of the two side faces 123 outwardly. Each of the ribs 1231 includes a holding portion 1232 outwardly protruding from a rear end thereof. Each of the ribs 1231 is received in the groove 1131, and the holding portion 1232 is received in the fixing slot 1132.

Figure 6:
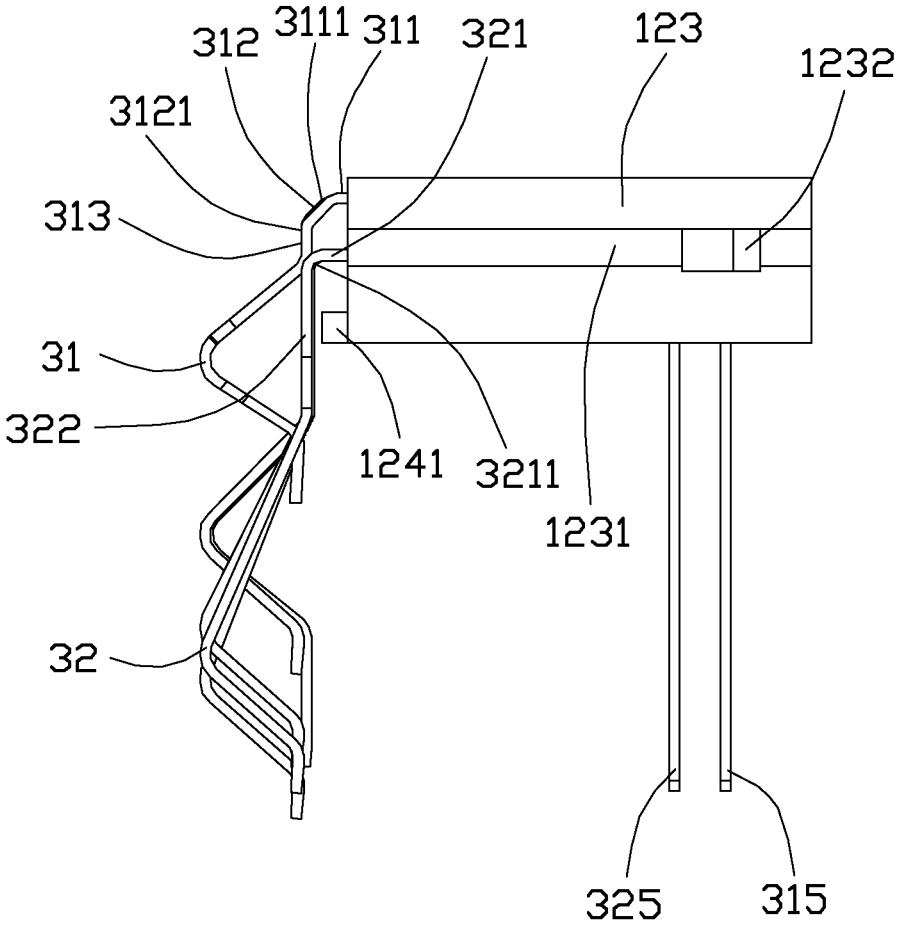
FIG. 6 is a side view of the contact module as shown in FIG. 5.

FIGS. 5-6 show the contacts including a first contact group and a second contact group. The first contact group includes a plurality of first contacts 31. The second contact group includes a plurality of second contacts 32, which is also called conductive contacts 32. The second contact group is used for connecting to a Secure Digital Memory Card electrically. The first contact group and the second contact group are used for connecting to a MultiMedia Card 4.0 electrically. The first contact 31 includes a first fixing portion (not shown) fixed into the insulative block 12, a first extending portion 311 extending from the first fixing portion, a first connecting portion 312 extending from the first extending portion 311 downwardly and forwardly, a first floating portion 313 extending from the first connecting portion 312 downwardly, and a first engaging/contacting portion 314 extending from the first floating portion 313 downwardly. The second contact 32 includes a second fixing portion (not shown) fixed into the insulative block 12, a second extending portion 321 extending from the second fixing portion, a second floating portion 322 extending from the second extending portion 321 downwardly, and a second engaging/contacting portion 323 extending from the second floating portion 322 downwardly. The rightmost contact 32 of the second contacts 32 includes a free end 324 extending from the second engaging portion 323 downwardly. The first engaging portion 314 is higher than the second engaging portion 323. The first fixing portions are aligned along a row and the second fixing portions are aligned along another row under the first fixing portions. Each of the first contacts 31 includes a first soldering foot 315 extending from the other end of the first fixing portion downwardly. Each of the second contacts 32 includes a second soldering foot 325 extending from the other end of the second fixing portion downwardly. The first soldering foot 315 and the second soldering foot 325 extend beyond the insulative block 12.

FIGS. 4-5 show the insulative block 12 including a plurality of tubers 1241 protruding from the front face 124 forwardly. Each of the tubers 124 is behind the second floating portion 322 and under the second extending portion 321. When the electrical card is not inserted into, the second floating portion 322 is separated from the tuber 1241.

The insulative block 12 is mounted into the mounting space 1141 from a back-to-front direction. The first contact group and the second contact group are received in the contact receiving slots 1161. The first engaging portions 314 and the second engaging portions 323 are exposed in the receiving space 1120. The first soldering feet 315 and the second soldering feet 325 are received in the contact fixing slots 1151.

Each of the first contacts 31 includes a first bending point 3121 and a second bending point 3111. The first bending point 3121 is defined between the first floating portion 313 and the first connecting portion 312. The second bending point 3111 is defined between the first connecting portion 312 and the first extending portion 311. The second contact 32 includes a third bending point 3211 defined between the second floating portion 322 and the second extending portion 321. When the electrical card inserted into the receiving space 1120, the first engaging portion 314 deflects by a pushing force perpendicular to an insertion force backwardly and the first floating portion 313 deflects around the first bending point 3121 backwardly. When the first floating portion 313 deflects to a certain location backwardly, the first connecting portion 312 deflects around the second bending point 3111 backwardly. This strengthens an elasticity of the first contact 31. When the electrical card pushes the second engaging portion 323, the second floating portion 322 deflects around the third bending point 3211 backwardly, till the second floating portion 322 relies on the tuber 1241 and a relying point is formed. Because of the tuber 1241, the relying point become a revolving point instead of the third bending point 3211, and this can protect the third bending point 3211. This prevent the second contact 32 from revolving around the third bending point 3211 excessively, and this strengthens an elasticity of the second contact 32.

The shell 2 includes an upper shell 22 and a lower shell 21. The lower shell 21 defines a cavity 211 and an elastic arm 212. The bottom wall 111 of the insulative housing 1 is received in the cavity 211. The upper shell 22 covers the insulative housing 1. The upper shell 22 includes a window 221 corresponding to the opening 1121. The upper shell 22 includes a plurality of the soldering portions 222 extending from a side plate downwardly.

FIGS. 2-3 show each of the two side walls 113 of the insulative housing 1 including a contact setting slots 1133 extending to the receiving space 1120. One of the two side walls 113 includes a contact recessing slot 1134 defined behind the contact setting slot 1133. The additional contacts 4 include a first detecting contact 41 and a second detecting contact 42. The first detecting contact 41 and the second detecting contact 42 are installed in the two side walls 113 of the insulative housing 1. The first detecting contact 41 includes a first fixing portion 411, a first tensile portion 412 extending from the first fixing portion 411 upwardly, a first guiding portion 413 bending from the first tensile portion 412 upwardly, and a first contact portion 414 extending from the first guiding portion 413. The first contacting portion 414 does not contact with the shell 2. The first detecting contact 41 and the shell 2 used for detecting a writing protect state of the electrical card. The second detecting contact 42 includes a second fixing portion 421, a second contact portion 422 extending from the second fixing portion 421 horizontally, and a second guiding portion 423 extending from the second fixing portion 421 upwardly. The second contact portion 422 is located behind the free end 324 of the second contact 32. The second guiding portion 423 connects with the elastic arm 212 of the lower shell 21. When the electrical card is inserted into the electrical card connector, the free end 324 of the second contact 32 connects to the second contact portion 422 of the second detecting contact 42, and the second detecting contact 42 and a second contact 32 are used for detecting an insertion state of the electrical card connector. The additional contacts 4 also include a strengthening contact 43 defined in front of the second detecting contact 42. The strengthening contact 43 includes an elastic portion 431 received in the contact setting slot 1133 and protruding to the receiving space 1120. The elastic portion 431 is used for strengthening the insertion force of the electrical card.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector comprising:

an insulative housing;

a contact module fixed in the insulative housing, the contact module having an insulative block and a plurality of conductive contacts, each of the conductive contacts comprising a fixing portion extending along a horizontal direction and received in the insulative block, an extending portion extending from the fixing portion forwardly, a floating portion extending from the extending portion downwardly, and an engaging portion bending from the floating portion downwardly, the conductive contact defining a bending point between the floating portion and the extending portion; and a shell covering the insulative housing; wherein the insulative block comprises a plurality of tubers monolithically formed with the insulative block and protruding from a front face forwardly, each of said tubers aligned with the corresponding contact to be located behind the floating portion and under the extending portion; wherein when the engaging portion is pushed backwardly, the floating portion deflects around the bending point initially and abuts against the tuber successively to deflect around the tuber continually.

2. The electrical card connector as claimed in claim 1, wherein the contact module also comprises a plurality of first contacts, each of the first contact comprises a first fixing portion extending along a horizontal direction and received in the insulative block, a first extending portion extending from the first fixing portion forwardly, a first connecting portion extending from the first extending portion downwardly and forwardly, a first floating portion extending from the first connecting portion downwardly and a first engaging portion bending from the first floating portion downwardly, each of the first contacts defines a first bending point and a second bending point, the first bending point is defined between the first floating portion and the first connecting portion, the second bending point is defined between the first connecting portion and the first extending portion.

3. The electrical card connector as claimed in claim 2, wherein the insulative block comprises a top face, a bottom face, a front face and a rear face, the insulative block has a plurality of cutouts recessed from a front face backwardly, the cutouts extend through the top face and the bottom face, the first extending portions of the second contacts are received in the cutouts.

4. The electrical card connector as claimed in claim 2, wherein a mating standard for a mating SD card is formed by the first contacts, and a mating standard for a mating MMC 4.0 card is formed by the first contacts and the conductive contacts together.

5. The electrical card connector as claimed in claim 1, wherein the conductive contacts are insert-molded in the insulative block.

6. The electrical card connector as claimed in claim 1, wherein the insulative housing comprises a first detecting contact and a second detecting contact, the first detecting contact and the shell are used for detecting a writing protect state of an electrical card, the second detecting contact and the outmost contact of the second contacts are used for detecting an inserting state of the electrical card.

7. The electrical card connector as claimed in claim 6, wherein the side wall of the insulative housing comprises a strengthening contact, the strengthening contact is located in front of the second detecting contact, the strengthening contact is used for strengthening an insertion force of the electrical card.

8. An electrical connector for use with a card, comprising:

an insulative housing;

a plurality of contacts disposed within the housing, each of said contacts including a fixing portion immovable relative to the housing, a floating portion linked to the fixing portion, and a contacting portion extending downwardly and inwardly from the floating portion and into the receiving slot in a cantilevered manner; wherein said contacts are integrally formed within an insulative block to commonly form a contact module which is configured to be assembled to the housing in a transverse direction; wherein the insulative block forms a plurality of tubers monolithically formed with the insulative block and each spaced from while aligned with the floating portion of the corresponding contact in the transverse direction; wherein the floating portion of each of the contacts is adapted to abut against the corresponding tuber in a successive stage during deflection.

9. The electrical connector as claimed in claim 8, wherein said housing defines a mounting surface which is higher than a bottom surface of the housing.

10. The electrical connector as claimed in claim 8, wherein the insulative housing defines a receiving slot extending along a longitudinal direction perpendicular to said transverse direction, and communicating upwardly with an exterior in a vertical direction perpendicular to both said transverse direction said longitudinal direction for receiving the card.

11. The electrical connector as claimed in claim 10, further including a detecting contact at around one end of the housing in said longitudinal direction, wherein said detecting contact is deflectable in said longitudinal direction to contact a metallic shell enclosing the housing, corresponding to insertion of the card into the receiving slot.

12. The electrical connector as claimed in claim 10, further including a detecting contact located around one end of the housing in said longitudinal direction, and an outermost contact of said contacts is deflectable in said transverse direction to contact said detecting contact when the card is received in the receiving slot.

13. The electrical connector as claimed in claim 12, further including a metallic shell enclosing said housing, wherein said shell constantly mechanically and electrically contacts said detecting contact in said longitudinal direction.

14. An electrical connector for use with a card, comprising:

an insulative housing defining a receiving slot extending along a longitudinal direction and communicating upwardly with an exterior in a vertical direction perpendicular to said longitudinal direction for receiving the card; and a plurality of contacts disposed within the housing, each of said contacts including a fixing portion immovable relative to the housing, a floating portion linked to the fixing portion, and a contacting portion extending downwardly and inwardly from the floating portion and into the receiving slot in a cantilevered manner;

wherein said contacts are integrally formed with an insulative block which is assembled to the housing;

wherein said insulative block forms a plurality of tubers monolithically formed with the insulative block and each spaced from while aligned with the floating portion of the corresponding contact in a transverse direction perpendicular to both said longitudinal direction and said vertical direction; wherein each of said tubers, against which the floating portion of the corresponding contact is adapted to abut, forms an abutment point about which the corresponding contact is deflected at a successive stage.

15. The electrical connector as claimed in claim 14, wherein said housing defines a mounting surface which is higher than a bottom surface of the housing.

16. The electrical connector as claimed in claim 14, wherein a first detecting contact is located around one end of the housing in said longitudinal direction and constantly contacting a metallic shell which encloses the housing, an outermost contacts of said contacts is deflectable in said transverse direction to contact said first detecting contact when the card is received in the receiving slot.

17. The electrical connector as claimed in claim 16, wherein said insulative block is configured to be assembled to the housing in said transverse direction.

18. The electrical connector as claimed in claim 16, further including a second detecting contact located around one end of the housing in said longitudinal direction, said second detecting contact contacts another metallic shell which encloses the housing corresponding to insertion of the card into the receiving slot.

19. The electrical connector as claimed in claim 18, wherein said first detecting contact and said second detecting contact are located around the same end of the housing in said longitudinal direction.

* * * * *